United States Patent [19]

Kwok

[11] Patent Number: 5,057,005

[45] Date of Patent: Oct. 15, 1991

[54] CANDLE DEVICE

[76] Inventor: Wai-Shi Kwok, Room 26, 25th Floor, Block C, Metropole Bldg., 7 King's Rd., North Point, Hong Kong

[21] Appl. No.: 356,687

[22] Filed: May 25, 1989

[51] Int. Cl.[5] ..... F23D 3/02

[52] U.S. Cl. ..... 431/253; 431/289; 84/2; 84/171

[58] Field of Search ..... 431/289, 290, 291, 253, 431/75, 85, 21; 84/2, 170, 171

[56] References Cited

U.S. PATENT DOCUMENTS

| | | | |
|---|---|---|---|
| 3,762,857 | 10/1973 | Andeweg | 431/253 |
| 4,234,303 | 11/1980 | Neugart | 431/293 |
| 4,477,249 | 10/1984 | Ruzek et al. | 431/253 |
| 4,568,269 | 2/1986 | Lin | 84/2 |
| 4,797,088 | 1/1989 | Nakamura et al. | 431/79 X |
| 4,804,323 | 2/1989 | Kim | 431/253 |

FOREIGN PATENT DOCUMENTS

| | | |
|---|---|---|
| 0146247 | 6/1985 | European Pat. Off. . |
| 1049806 | 2/1959 | Fed. Rep. of Germany . |
| 3618309 | 12/1986 | Fed. Rep. of Germany . |
| 2175994 | 12/1986 | United Kingdom . |
| WO/8404375 | 11/1984 | World Int. Prop. O. . |

*Primary Examiner*—Carl D. Price

*Attorney, Agent, or Firm*—Leydig, Voit & Mayer

[57] ABSTRACT

A candle device comprises a wax body which is urged upwardly by a spring against a thermally-insulating cover. A wick projects through an aperture in the cover, and wires conduct heat from the candle flame to melt wax beneath the cover. A music generator in the form of an integrated circuit and a speaker is triggerable by a sensor to play music while the candle is burning. The sensor may take the form of a temperature-sensitive resistor, a photocell or a bimetallic switch. Other forms utilize a thermally-conducting wire to conduct heat from the candle flame to expand air in a container to operate a mechanical switch. Also disclosed is a time delay switch in the form of a tube of porous material. Water is absorbed along the tube and changes the capacitance between pairs of plates, each pair activating the integrated circuit to play a respective tune.

14 Claims, 2 Drawing Sheets

CANDLE DEVICE

FIELD OF THE INVENTION

The present invention relates to a candle device incorporating a music generator.

DESCRIPTION OF PRIOR ART

It is known to provide, as disclosed in U.S. Pat. No. 4,755,135, a candle in the form of a wax body having an embedded or replaceable wick and supported by a spring within a tubular outer casing which has a thermally-insulating lining. A thermally-insulating cover extends across the upper end of the tubular outer casing and the wick extends through an aperture in the cover. Thermally-conducting wires extend from the aperture in the cover to conduct heat to the periphery of the candle body below the cover to ensure uniform melting of the wax which flows through apertures in the cover. As the candle burns, the spring urges the candle body upwards towards the cover to maintain the flame of the burning wick at a generally constant height.

SUMMARY OF THE INVENTION

A first aspect of the invention provides a candle housed in a container, a cover comprising a thermally-insulating plate located on top of the container and covering an upper surface of the candle, the plate having an aperture or slot through which a wick of the candle projects, means for urging the candle upwardly in the container and means for conducting heat from the region of the candle wick to beneath the cover, wherein there is provided a music generator and switching means for switching on said music generator to play music.

A second aspect of the invention provides a candle and a music generator, the candle comprising a wick extending through the body of the candle and switching means comprising a thermally-conducting member extending along the wick, the member being arranged to melt under the heat of the candle flame, and means responsive to heat conducted along said member from the vicinity of the candle flame to activate said music generator.

A third aspect of the invention provides a candle device comprising a candle, a music generator and switching means for activating the music generator, said switching means comprising an elongate tube having porous material therein arranged to absorb liquid along the tube from a reservoir, and a plurality of detectors arranged in the tube to detect the arrival of the liquid and activate the music generator.

Preferred features and advantages of the invention will be apparent from the following description and the accompanying claims.

DESCRIPTION OF PREFERRED EMBODIMENTS

Figure 1:
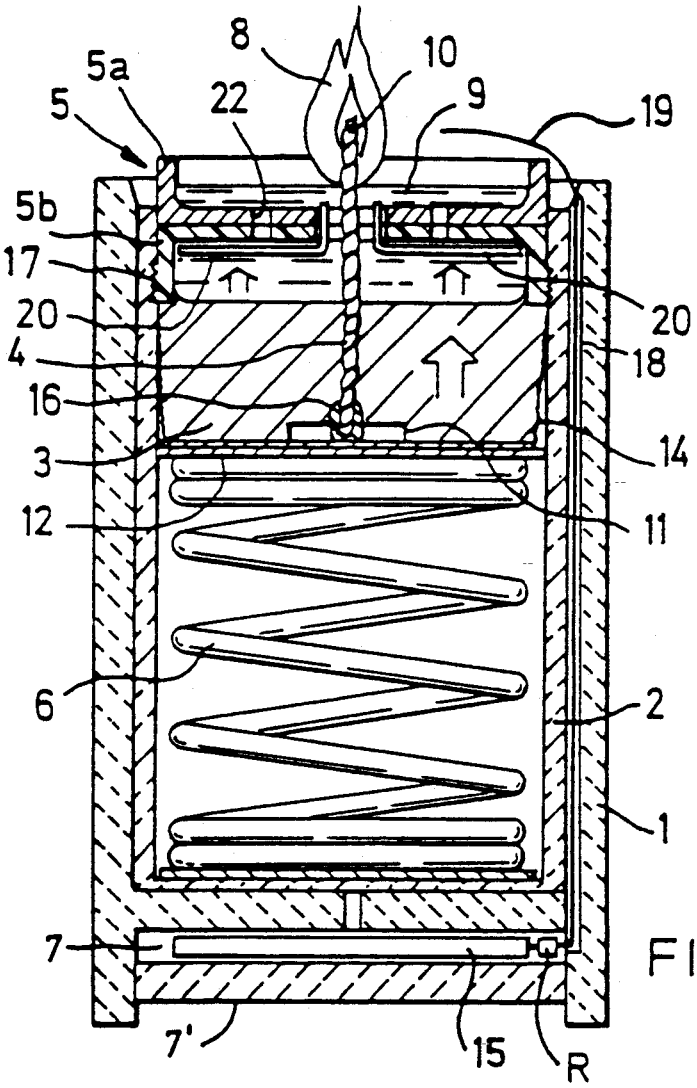
FIG. 1 is a cross-sectional view through a first embodiment of a candle device in accordance with the invention.
Figure 2:
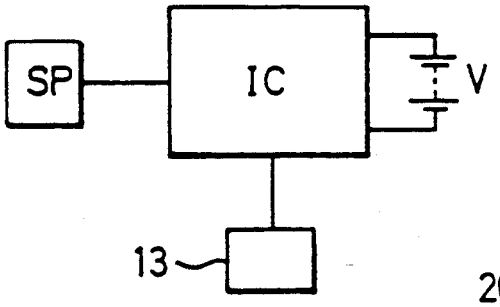
FIG. 2 is a circuit diagram of a music generator for use in a candle device according to the invention.

Referring firstly to FIGS. 1 and 2 of the drawings, the candle device shown therein comprises a tubular outer casing 1 and an inner lining 2 of thermally-insulating material, a candle having a wax body 3 with an embedded wick 4, an apertured thermally-insulating cover 5 extending across the upper end of the casing 1 and a compression spring 6 within the casing 1 below the wax body 3. The casing 1 can be formed of any appropriate material such as porcelain, plastics, metal or wax, and can be provided with a plain or decorative external surface. The lining 2 fits snugly in the casing 1. The wax body 3 has a rigid base plate 12 attached to its bottom end. The wick 4 whilst being embedded in the wax body 3 is attached to the centre of the plate 12 by means of a clip 16 on an apertured aluminium disc 11 to prevent sideways movement of the lower end of the wick 4 when burning of the wax body 3 is nearly complete. A stiff support member 10, for example of bamboo fibre, is provided within the wick 4 to keep the latter upright.

The wax body 3 and the base plate 12 are contained within the lining 2 below the cover 5 in an open-topped thin flexible casing 14 and is subject to an upward force exerted by the compression spring 6. The casing 14 is preferably formed of cellulose or polyethylene film although it may, for instance, be of aluminium foil. The casing 14 is trapped between the cover 5 and the lining 2 and retains the molten wax at the final burning stage of the wax body 3. It also serves to prevent sticking of the wax body 3 to the lining 2.

The cover 5, which is made of thermally-insulating material such as a hard, high melting point thermoset resin material, comprising a flat member and a cylindical, longitudinally-extending rim integral with the flat member. The rim has an external screw thread 17 which is screw-threadably engageable with an internal thread 18 on the lining 2 to clamp the upper end of the thin casing 14. The cover 5 has a central aperture 19 through which the wick 4 extends and a plurality of other openings 22 through which molten wax can flow from beneath the cover 5 to the surface. The number of the openings 22 depends on the nature of wax used for the wax body 3 and the diameter of the wax body 3. Thermally-conducting metal wires 20 extend from the aperture 19 to conduct heat from the region of the wick 4 to the periphery of the wax body 3 below the cover 5, to melt the wax across the full diameter of the wax body 3.

The cover 5 comprises an upper part **5*a* of flame-resistant material, such as metal or porcelain, and a lower part 5*b* of thermally-insulating material, such as plastics, wood or multi-ply paper, the two parts 5*a*, 5*b*** being glued together.

In use, as the candle burns, molten wax 9 is formed above the solid wax body 3. There is a transition zone between the solid and molten wax where the wax is soft but not molten. The molten wax 9 flows into and is retained by the upper part 5a of the cover 5 through the openings 19, 22. As the wax burns, the spring 6 relaxes and pushes the body 3 upwards in such a manner that the surface level of the molten wax 9 is maintained substantially constant and without overflowing the cover 5.

The casing 1 of the candle device maintains its external appearance throughout the burning of the candle, and can be used with replaceable wax bodies 3.

A compartment 7 is formed at the bottom of the casing 1 for accommodating a music generator 15, the compartment 7 is closed from below by a lid 7'. The music generator 15 operates to play music in response to the burning of the candle.

As best shown in FIG. 2, the music generator 15 comprises an integrated circuit IC, a d.c. battery V, a piezo-electric crystal speaker SP, and switching means 13, being electrically connected together as shown. The integrated circuit IC has a memory storing one or more musical tunes. When an appropriate signal to is applied the integrated circuit IC from switching means 13, the integrated circuit IC is triggered to provide an electrical output signal corresponding to one of the stored musical tunes to drive the speaker SP.

The switching means 13 is arranged to trigger the integrated circuit IC in response to the presence of a candle flame 8 at the wick 4 when the candle is burning. The switching means 13 may comprise a photo-sensitive resistor R which detects the presence of the candle flame 8 by means of an elongate fibre optic 19 extending from the region of the upper end of the candle wick 4. The fibre optic 19 may extend between the casing 1 and the lining 2, as shown in FIG. 1, or extend along side candle wick 4, both being embedded in the wax body 3. Alternatively, the photo-sensitive resistor R may be mounted at the top of the casing 1 so that light from the candle flame 8 will fall directly on the resistor R.

A second type of the switching means 13 may include a thermo-sensitive resistor R' which detects the presence of the candle flame 8 by means of a thermally-conducting wire 19' which extends along a similar path as the fibre optic 19, the resistor R' may be placed in the vicinity of the candle flame. When the thermally-conducting wire is used, it is preferred that heat is insulated along its length so as not to damage or melt other parts of the candle device.

In place of the thermo-sensitive resistor, infra-red sensitive diode may detect infra-red radiation given off by the heated wire.

Figure 3:
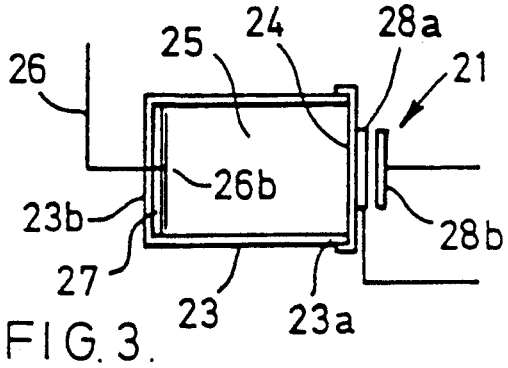
FIG. 3 illustrates a first embodiment of a switch of a switching means for use in a candle device according to the invention.

FIG. 3 shows a third type of the switching means 13 which includes a pressure-sensitive switch 21. A sealed container 23 is closed at one end 23a by a flexible or elastic membrane 24, and contains thermally-expansible material 25, for example air. A thermally-conducting wire 26 extends from the region of the candle flame 8 into the other end 23b of the container 23 where the wire 26 is laid as a flat spiral 26b on a thermally-insulating plate 27. Heat from the candle flame passes along the wire 26 to heat the material (air) 25 which thus expands and bows the membrane 24 outwards.

The pressure sensitive switch 21 comprises movable and stationary contacts 28a and 28b. The movable contact 28a is located on the membrane 24, and is arranged to contact the stationary contact 28b when the membrane 24 is sufficiently bowed. The pressure-sensitive switch 21, when closed, will trigger the integrated circuit IC to play a tune.

Figure 4:
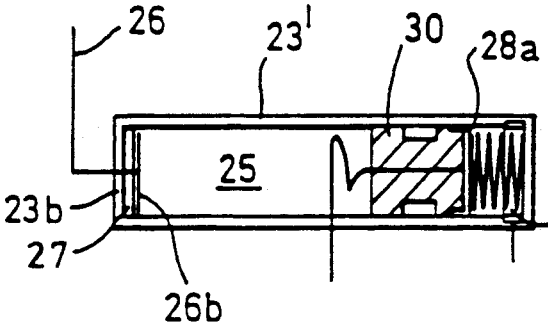
FIG. 4 illustrates a second embodiment of a switch of a switching means for use in a candle device according to the invention.

FIG. 4 shows a second embodiment of a switch mechanism, similar to that of FIG. 3. In place of the membrane 24, a piston 30 and cylinder 23' arrangement is provided. As the air 25 in the cylinder 23' expands, the piston 30 is urged along the cylinder 23 against the biasing force of the spring 31, the end 23a of the cylinder having aperture 31. The piston 30 carries a first switch contact 28a' and a second switch contact 28b' is mounted at the cylinder end 23a. When the wire 26 heats the air 25 to a sufficient extent the piston is pushed to the end of the cylinder against the force of spring 31, closing the switch contacts 28a', 28b' together.

Figure 5:
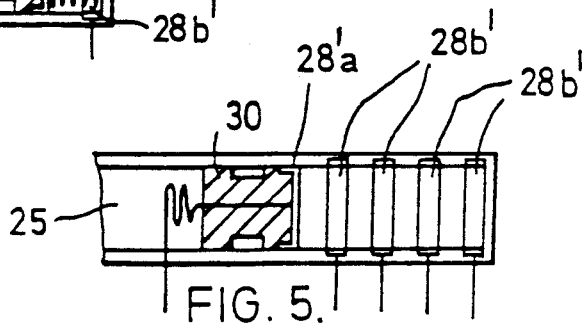
FIG. 5 illustrates a third embodiment of a switch of a switching means for use in a candle device according to the invention.

FIG. 5 shows a modification of the embodiment of FIG. 4 in which several switch contacts 28b' are arranged along the cylinder 23. As the temperature of the air 25 increases, the piston is pushed further along the cylinder and contact 28a' makes contact with each contact 28b' in turn. Each contact 28b' forms an input to the integrated circuit IC, and the integrated circuit IC is arranged to play a number of different tunes. As contact is made between contact 28a' and each contact 28b' in turn a different tune is played by the integrated circuit IC.

Figure 6:
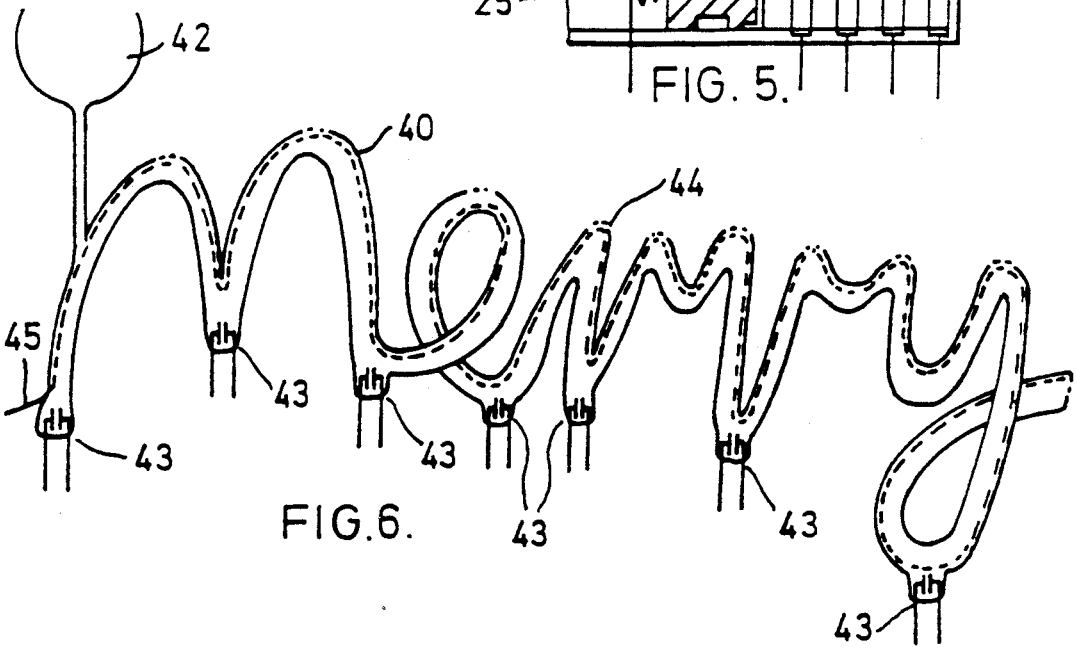
FIG. 6 illustrates a fourth embodiment of a switch of a switching means for use in a candle device according to the invention.
Figure 7:
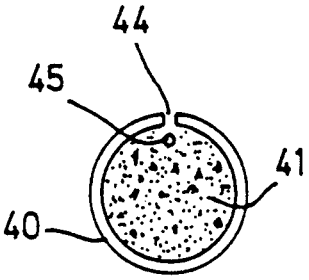
FIG. 7 shows a cross-section through the switch of FIG. 6.

FIG. 6 shows a switch mechanism which operates independently of the candle. An elongate glass tube 40 is formed into the shape of a word. The tube 40 is packed with a mix 41 of porous material and copper (II) sulphate crystals. To start the switch mechanism, water is poured into a reservoir 42 at one end of the tube 40. The water is slowly absorbed along the tube 40 by the porous material. As the water moves along the tube 40, it dissolves the copper (II) sulphate crystals and forms a blue solution. Pairs of opposed electrical contacts 43 are fixed in the tube at intervals along its length. The opposed contacts 43 form plates of a capacitor. As the water reaches the contacts 43, the capacitance between them changes, and this can be detected by the integrated circuit IC to trigger the integrated circuit IC to play a tune. Each pair of contacts 43 is preferably arranged to trigger the playing of a different tune, or the same tune may be repeated. Apertures 44 in the top of the tube allow for the water to evaporate after use, so that the switch can be re-used. A heating wire 45 is provided in the tube 40 to dry out the mix 41.

Figure 8:
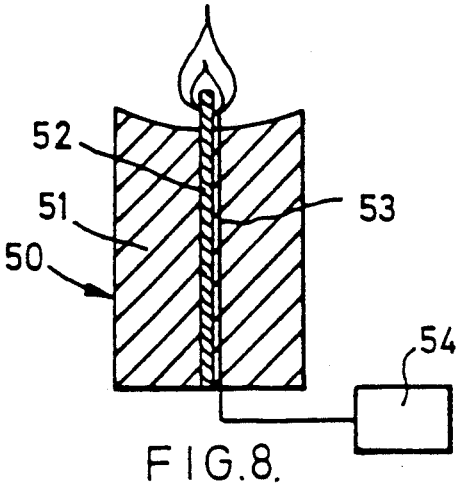
FIG. 8 shows another embodiment of a candle device in accordance with the invention.

FIG. 8 shows a candle 50 of traditional form comprising a wax body 51 having an embedded wick 52. A thermally-conducting wire 53 extends through the body 51 adjacent the wick 52. The wire 53 may extend through the centre of the wick 52. The wire 53 is of low melting point so that it melts and/or burns away as the candle burns. Heat is conducted by the wire 53 to a sensor or switch 54 which may take for example, the form of the switch mechanism of FIGS. 3, 4 or 5, a temperature-sensitive resistor, or an infra-red sensitive diode which reacts in response to infra-red light emitted by the heated wire 53. The sensor 54 in turn triggers the integrated circuit IC to play a tune (FIG. 2).

A plurality of sensors may be arranged around the candle flame; they may be fixed at different distances from the flame and/or embedded at different heights in the candle wax body. Each sensor may provide a signal for the integrated circuit IC, being coupled directly to the integrated circuit IC or being arranged to activate a switch as in the embodiment of FIGS. 3, 4 or 5.

A manually-operable on-off switch may be provided electrically in series with the battery V to control the operation of the music generator.

Various modifications may be made to the described embodiments and it is desired to include all such modifications as fall within the scope of the accompanying claims.

What is claimed is:

1. A candle device comprising a candle housed in a container having a bottom and a compartment formed at the bottom, a cover comprising a thermally-insulating plate located on top of the container and covering an upper surface of the candle, the plate having an aperture through which a wick of the candle projects, means for urging the candle upwardly in the container, a thermally conducting member which conducts heat from the region of the candle wick to the compartment, a music generator disposed in the compartment, and switching means disposed in the compartment for switching on said music generator to play music responsive to the heat conducted by said member, said switching means comprising a sealed container having a wall comprising at least in part a flexible membrane, said thermally-conducting member being in thermal contact with contents of the container to heat the contents, whereby the contents of the container expand and cause said membrane to flex outwardly, and a pressure-sensitive switch located in the path of said membrane and activated by the membrane to turn on the music generator.

2. A candle device comprising a candle having a wick extending through the candle, a music generator, a thermally-conducting member extending along the wick, the member being made of a material which melts under heat of a flame of the candle and conducts the heat along said member, and switching means responsive to the heat conducted by said member for activating said music generator, said switching means comprising a sealed container having a wall comprising at lest in part a flexible membrane, said thermally-conducting member being in thermal contact with contents of the container to heat the contents, whereby the contents of the container expand and cause said membrane to flex outwardly, and a pressure-sensitive switch located in the path of said membrane and activated by the membrane to turn on the music generator.

3. A candle device comprising a candle having a wick extending through the candle, a music generator, a thermally-conducting member extending along the wick, the member being made of a material which melts under heat of a flame of the candle and conducts heat along said member, and switching means responsive to the conducted heat for activating said music generator, said switching means comprising a piston and cylinder, said thermally-conducting member being in thermal contact with contents contained between the piston and cylinder to heat said contents and move the piston along the cylinder, said piston being arranged to operate a switch when it moves along the cylinder.

4. A candle device comprising a candle housed in a container having a bottom and a compartment formed at the bottom, a cover comprising a thermally-insulating plate located on top of the container and covering an upper surface of the candle, the plate having an aperture through which a wick of the candle projects, means for urging the candle upwardly in the container, a thermally conducting member which conducts heat from the region of the candle wick to the compartment, a music generator disposed in the compartment, and switching means disposed in the compartment for switching on said music generator to play music responsive to the heat conducted by said means for conducting heat, said switching means comprising a piston and cylinder, said thermally-conducting member being in thermal contact with contents contained between the piston and cylinder to heat said contents and move the piston along the cylinder, said piston being arranged to operate a switch when it moves along the cylinder.

5. A candle device as claimed in claim 4, wherein said piston operates in turn a plurality of switches as it moves along the cylinder and said music generator is arranged to play a plurality of tunes, a respective tune being played as each switch is activated.

6. A candle device comprising:

a candle body;

a wick embedded in the candle body;

a heat conducting wire having upper and lower ends embedded in the candle body and extending along the candle wick;

a music generator; and switching means external of the candle body, connected to the lower end of the candle wick for activating the music generator in response to heat conducted along the wire from the vicinity of a flame on the candle wick, the wire being composed of a material which melts or burns away at its upper end by the heat of the candle flame.

7. A candle device as claimed in claim 6 wherein said switching means comprises two switch contacts and a sealed chamber containing a thermally expandable substance which is in thermal contact with the lower end of the wire and having a movable part which is associated with the switch contacts so that expansion of the substance in response to heat from the wire will cause the part to move to bring the switch contacts into electrical contact in order to activate the music generator.

8. A candle device as claimed in claim 6 wherein said switching means comprises an infrared diode operable in response to infrared radiation emitted by the lower end of the wire when heat is conducted along the wire.

9. A candle device comprising:

a candle body;

a wick embedded in the candle body;

a music generator;

heat sensing means for sensing the presence of a candle flame on the wick; and pressure-sensitive switching means for activating the music generator in response to said heat sensing means sensing the presence of the candle flame, said switching means comprising two switch contacts and a sealed chamber containing a thermally expandable substance which is in thermal contact with said heat sensing means and having a movable part which is associated with the switch contacts so that expansion of the substance in response to heat from said heat sensing means will cause the part to move to bring the switch contact into electrical contact in order to activate the music generator.

10. A candle device as claimed in claim 9 wherein one of the switch contacts is a fixed contact and another of the switch contacts is movable by the part of the chamber.

11. A candle device as claimed in claim 10 wherein said switching means further comprises at least one additional fixed switch contact and the movable switch contact is arranged to make electrical contact in turn with the fixed switch contacts as the movable switch is moved along in order to activate the music generator at different times.

12. A candle device as claimed in claim 10 wherein the chamber is provided by a container having an aperture and a membrane covering the aperture, the movable switch contact being movable by the membrane.

13. A candle device as claimed in claim 10 wherein the chamber is defined by a piston and cylinder, the movable switch contact being movable by the piston.

14. A candle device as claimed in claim 9 further comprising a casing in which the candle body is housed, a cover comprising a thermally insulating plate located on the top of the casing and covering an upper surface of the candle body, the plate having an aperture through which the candle wick extends, urging means for urging the candle body upwardly in the casing, and conducting means for conducting heat from the region of the candle wick to beneath the cover.

* * * * *